United States Patent [19]

Yamat

[11] 4,259,651

[45] Mar. 31, 1981

[54] CURRENT LIMITING CIRCUIT INTERRUPTER WITH IMPROVED OPERATING MECHANISM

[75] Inventor: Miguel B. Yamat, Greendale, Wis.

[73] Assignee: Westinghouse Electric Corp., Pittsburgh, Pa.

[21] Appl. No.: 951,939

[22] Filed: Oct. 16, 1978

[51] Int. Cl.[3] ..... H01H 75/12; H01H 9/20

[52] U.S. Cl. ..... 335/16; 335/170; 335/171; 335/195

[58] Field of Search ..... 335/15, 16, 21, 22, 335/167, 168, 169, 170, 171, 172, 173, 174, 195

[56] References Cited

U.S. PATENT DOCUMENTS

| | | | |
|---|---|---|---|
| 3,343,108 | 9/1967 | Murai | 335/16 |
| 3,469,216 | 9/1969 | Shiraishi | 335/16 X |
| 3,663,903 | 5/1972 | Kussy et al. | 335/16 |

FOREIGN PATENT DOCUMENTS 1193222 5/1970 United Kingdom .

1214363 12/1970 United Kingdom .

*Primary Examiner*—Fred L. Braun

*Attorney, Agent, or Firm*—Robert E. Converse, Jr.

[57] ABSTRACT

A current limiting circuit interrupter includes two parallel pivoting contact arms carrying contacts at the ends thereof. The upper contact arm is pivoted upon a carriage which is in turn pivotally mounted upon a mechanism frame. A latch rod is movably secured in arcuate slots in the sides of the mechanism frame. When the circuit interrupter is in the closed circuit position, a pair of springs connected between the latch rod and the carriage urges the latch rod against a reaction surface of the upper contact arm to provide contact closing pressure. Upon occurrence of severe overload current conditions, the upper contact arm pivots upon the carriage, moving the latch rod within the arcuate slots to release the contact closing pressure, allowing the springs to move the latch rod against a latching surface of the upper contact arm to latch the upper contact arm in the open circuit position.

14 Claims, 5 Drawing Figures

CLOSED POSITION

NORMAL OPEN POSITION

TRIP POSITION

CURRENT LIMITING POSITION

CURRENT LIMITING CIRCUIT INTERRUPTER WITH IMPROVED OPERATING MECHANISM

CROSS REFERENCE TO RELATED APPLICATIONS

The invention is related to material disclosed in copending U.S. Pat. Application Ser. No. 951,940, entitled "Current Limiting Circuit Interrupter With Pivoting Contact Arm", filed Oct. 16, 1978 by John A. Wafer and Miguel B. Yamat, and U.S. Pat. Application Ser. No. 951,938, filed Oct. 16, 1978 by Walter W. Lang, John A. Wafer, and Miguel B. Yamat.

BACKGROUND OF THE INVENTION

1. Field of the Invention

The present invention relates to electrical apparatus, and more particularly to circuit interrupters having current limiting capability.

2. Description of the Prior Art

Circuit interrupters are widely used to provide protection for electrical distribution systems against damage caused by overload, or fault, current conditions. As the capacity of power sources increased, it was necessary to provide increased interrupting capability for circuit breakers to properly protect the electrical distribution system. In order to provide this protection in a more economical manner, current limiting circuit interrupters were developed to limit the amount of fault current to a level below that which the source was capable of supplying.

One type of current limiting circuit interrupter employs a high-speed mechanism to rapidly separate the contacts upon occurrence of a fault condition to draw an arc between the contacts, allowing the voltage drop across the arc to limit the current flow. The electrodynamic force produced by the current flow through the circuit interrupter is used to rapidly drive the contacts apart and force the arc into an extinguishing device. The standard trip mechanism then actuates to maintain the contacts in the open circuit position.

All circuit breakers require a certain amount of contact closing force to reduce resistance between the contacts and, consequently, the amount of resistance heating generated during normal closed circuit conditions. This contact force is most commonly obtained by means of extension or compression springs attached to the contact arm. The higher the current rating of the circuit breaker, the greater the required contact force.

In a current limiting circuit breaker, however, the contact arms separate independently of other portions of the operating mechanism to produce the current limiting action and, in the process, stretch or compress the springs further from their normal positions. The resisting force supplied by these springs during current limiting operation thus significantly reduces the acceleration of the contact arms and the degree of current limiting, especially with higher circuit breaker ratings. It is therefore desirable that the contact spring force be eliminated or kept to a minimum in order to produce maximum acceleration of the contact arm during current limiting, yet provide sufficient contact closing force during normal closed circuit conditions to reduce resistance heating of the circuit breaker contacts.

A current limiting circuit breaker supplying this contact spring force action must also provide the latching function needed to maintain the contacts in an open position during current limiting operation until the trip device can operate. Various methods have been employed to provide this latching function; however, for a variety of reasons they have not proven entirely satisfactory. It would be desirable, therefore, to provide a current limiting circuit interrupter having low-resistance contacts during closed circuit conditions which will rapidly separate upon occurrence of severe overload current conditions to provide current limiting operation, and a mechanism latching the contacts in the open circuit position until the normal trip mechanism can operate. In order to reduce costs and increase reliability, it is desirable that such a mechanism have a minimum of parts.

SUMMARY OF THE INVENTION

In accordance with a preferred embodiment of the present invention, there is provided a current limiting circuit interrupter which includes a housing, a pair of separable contacts disposed in the housing, and an operating mechanism for opening and closing the contacts. The operating mechanism comprises a frame mounted in the housing, a carriage pivotally mounted upon the frame, and a contact arm pivotally mounted upon the carriage and supporting one of the contacts. The carriage is pivoted by means such as a conventional toggle mechanism to operate the contacts by manual operation between open and closed positions and to automatically open the contacts when the toggle linkage is released by a conventional thermal, magnetic, or shunt trip device. A latch rod is movably connected to the frame and rides in arcuate slots in two frame side members. A tension spring connected between the carriage and the latch rod urges the latch rod against a reaction surface of the contact arm to provide contact closing force when the contacts are in closed circuit position. The latch rod also immobilizes the contact arm with respect to the carriage, so that under normal conditions, the contact arm and carriage pivot as a unit.

Conductor means are provided for connecting the contacts in series circuit relationship with an electrical circuit being protected. The conductor means are so arranged that an overcurrent condition through the contacts generates electrodynamic force upon the contact arm. This force causes the contact arm to pivot with respect to the carriage and move the latch rod against the action of the bias springs. As the latch rod moves along the arcuate slots, it passes out of the path of movement of the contact arm, releasing the contact closing force upon the contact arm and allowing it to freely pivot away from the closed position. The bias spring then causes the latch rod to snap back toward its original position so that when the electrodynamic force caused by overload current decreases, the contact arm is prevented from pivoting to return to the closed circuit position since a latching surface of the contact arm bears against the latch rod. The bias spring thus serves to provide a latching force to the contact arm until such time as the conventional trip device can release the toggle linkage, allowing the carriage to pivot to an open circuit position.

DESCRIPTION OF THE PREFERRED EMBODIMENT

Figure 1:
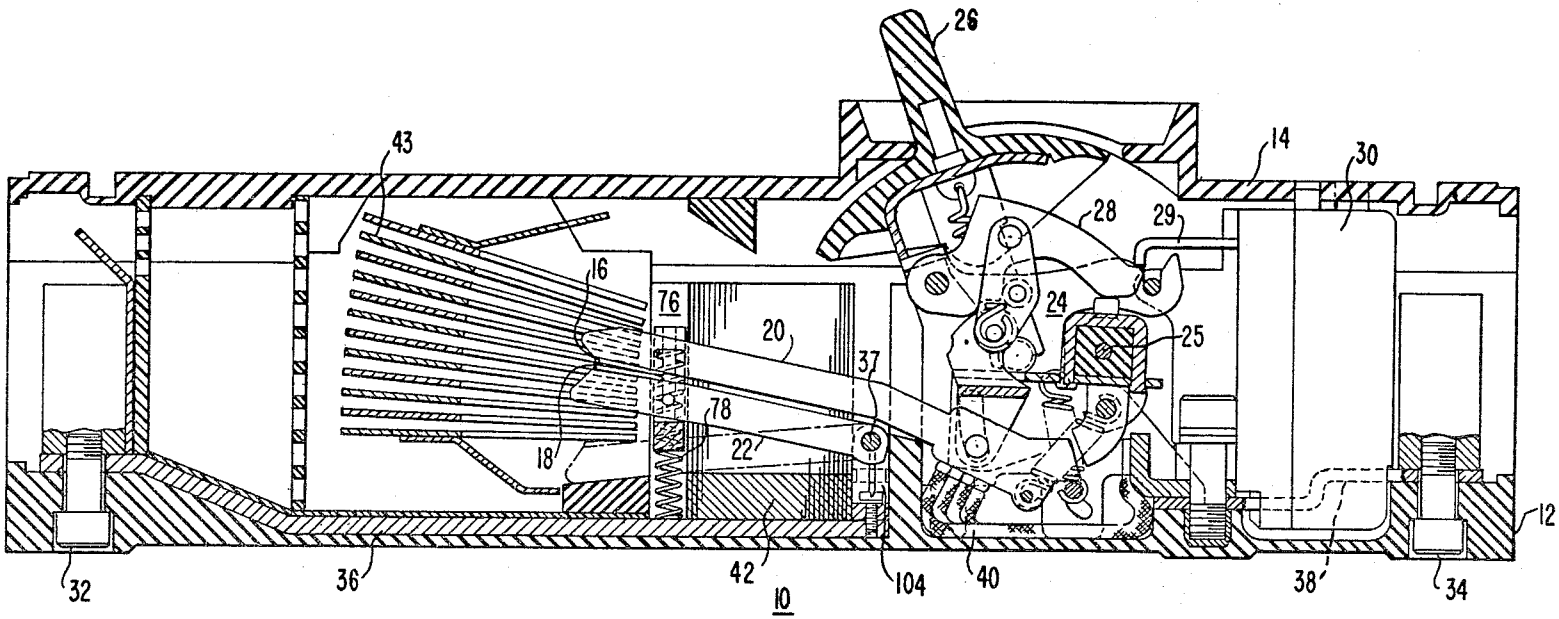
FIG. 1 is a side sectional view of a current limiting circuit breaker incorporating the principles of the present invention.

Referring now to the drawings, in which like reference characters refer to corresponding members, FIG. 1 shows a side sectional view of a current limiting circuit breaker 10 employing the principles of the present invention. The circuit breaker 10 includes a molded insulating housing 12 and a cooperating molded insulating cover 14. Upper and lower separable contacts 16, 18 are secured at the ends of upper and lower pivoting contact arms 20 and 22, respectively. Movement of the upper contact arm 20 is controlled by an operating mechanism indicated generally at 24 which is adapted for manual operation through a handle 26. Automatic opening operation upon normal overload currents is provided by a releasable latch 28 held during normal electrical conditions through the contacts 16, 18 by a member 29 attached to a trip unit 30. The trip unit 30 may include thermal, magnetic, and shunt trip mechanisms of conventional design and will not be here described in detail. Low to moderate overload current conditions as detected by the trip unit 30 will result in movement of the member 29 to release the latch 28 and allow the contact arm 20 to pivot upward.

Terminals 32 and 34 are adapted to connect the circuit breaker 10 in series circuit relationship with an electrical circuit to be protected. Conductors 36 and 38 are connected to terminals 32 and 34 respectively. The lower contact arm 22 is electrically connected to the conductor 36 with a clinch-type contact 37 described more completely in the aforementioned U.S. Pat. Application Ser. No. 951,940. A conductive shunt 40 is electrically connected between the upper contact arm 20 and the conductor 38. With the circuit interrupter 10 in the closed circuit position as shown in FIG. 1, an electrical circuit thus exists from terminal 32 through conductor 36, connection 37, contact arm 22, contact 18, contact 16, upper contact arm 20, shunt 40, and conductor 38 to the terminal 34. A magnetic drive, or slot motor, 42 operates to aid in rapid separation of the contact arms 20, 22 during current limiting operation, as will be more completely described hereinafter. Plates 43 are provided to aid in extinguishing an arc established by separation of the contacts 16, 18.

Figure 2:
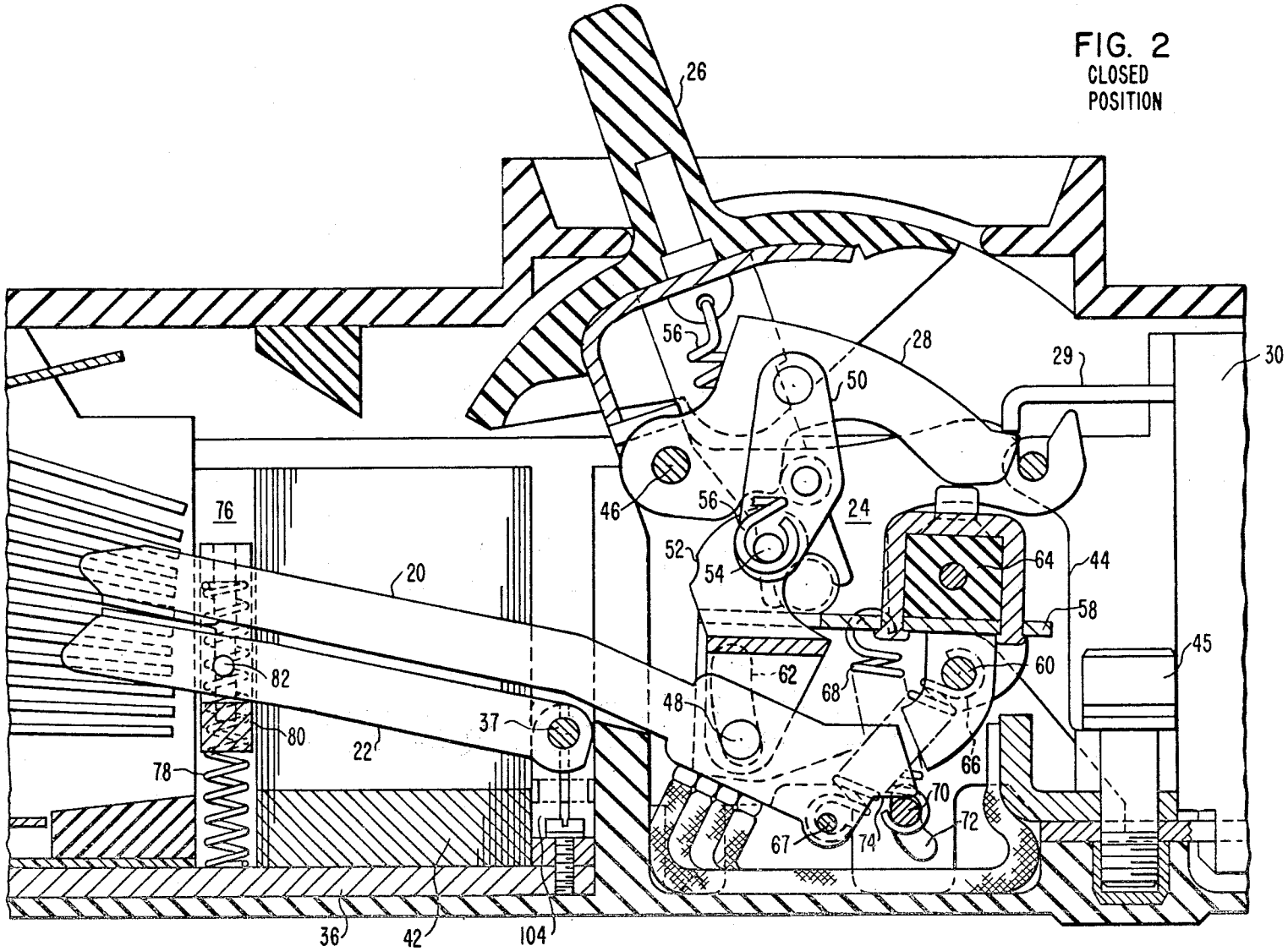
FIG. 2 is a detail side sectional view of the contact arms and operating mechanism of the circuit interrupter shown in FIG. 1, with the contacts in the closed position.

The construction of the operating mechanism 24 is shown in more detail in FIG. 2. A mechanism frame having side plate members 44 is secured to the housing 12 by a screw 45. The trip latch 28 is attached by a latch pivot pin 46 to the side plates 44. A toggle linkage consisting of an upper toggle link 50 and a lower toggle link 52 is pivotally connected between the trip latch 28 and the upper contact arm pivot pin 48. The upper and lower toggle links 50, 52, are joined by a toggle knee in 54, to which is attached an operating spring 56, also connected to the handle 26.

A U-shaped carriage 58 is pivotally mounted to the side plates 44 upon a carriage pivot pin 60. The upper contact arm pivot pin 48 is mounted in the carriage 58. The upper contact arm 20 and carriage 58 thus form contact support means having a plurality of pivot points 48 and 60. Therefore, during normal (non-current limiting) operations, the upper contact arm 20 pivots as a unit with the U-shaped carriage 58 about the rod 60. Since the lower toggle link 52 extends through the carriage 58 and is pivotally attached to the contact arm pivot pin 48, the extension or collapse of the toggle linkage 50, 52 serves to rotate the carriage 58 about the pin 60. Movement of the carriage 58 is constrained by slots 62 in the side members 44 within which ride the ends of the pivot pin 48. A cross arm 64 is fixedly secured to the carriage 58, and extends to identical carriages on side poles (not shown).

Light extension springs 66 are connected on both sides of the contact arm 20 between the rod 67 (attached to the arm 20) and the carriage pivot pin 60. Heavy extension springs 68 are connected between the carriage 58 and a movable latch pin 70 which is free to ride in arcuate slots 72 on the frame side members 44. With the circuit breaker in the closed position as shown in FIG. 2, it can be seen that the latch pin 70 is drawn against a reaction surface 74 of the contact arm 20 by the action of the heavy extension springs 68. The springs 66 and 68 are thus extended in tension and the contact arm 20 floats in equilibrium between the contact force produced between the contacts 16 and 18, the forces from the springs 66 and 68, and a reaction force produced by the carriage 58 upon the contact arm pivot pin 48.

The lower contact arm 22 is positioned by a spring biased shutter assembly 76 which includes a compression spring 78, a bearing member 80, and a limit pin 82. The compression springs 78 resist the contact force produced by the upper contact arm 20 upon the lower arm 22.

Figure 3:
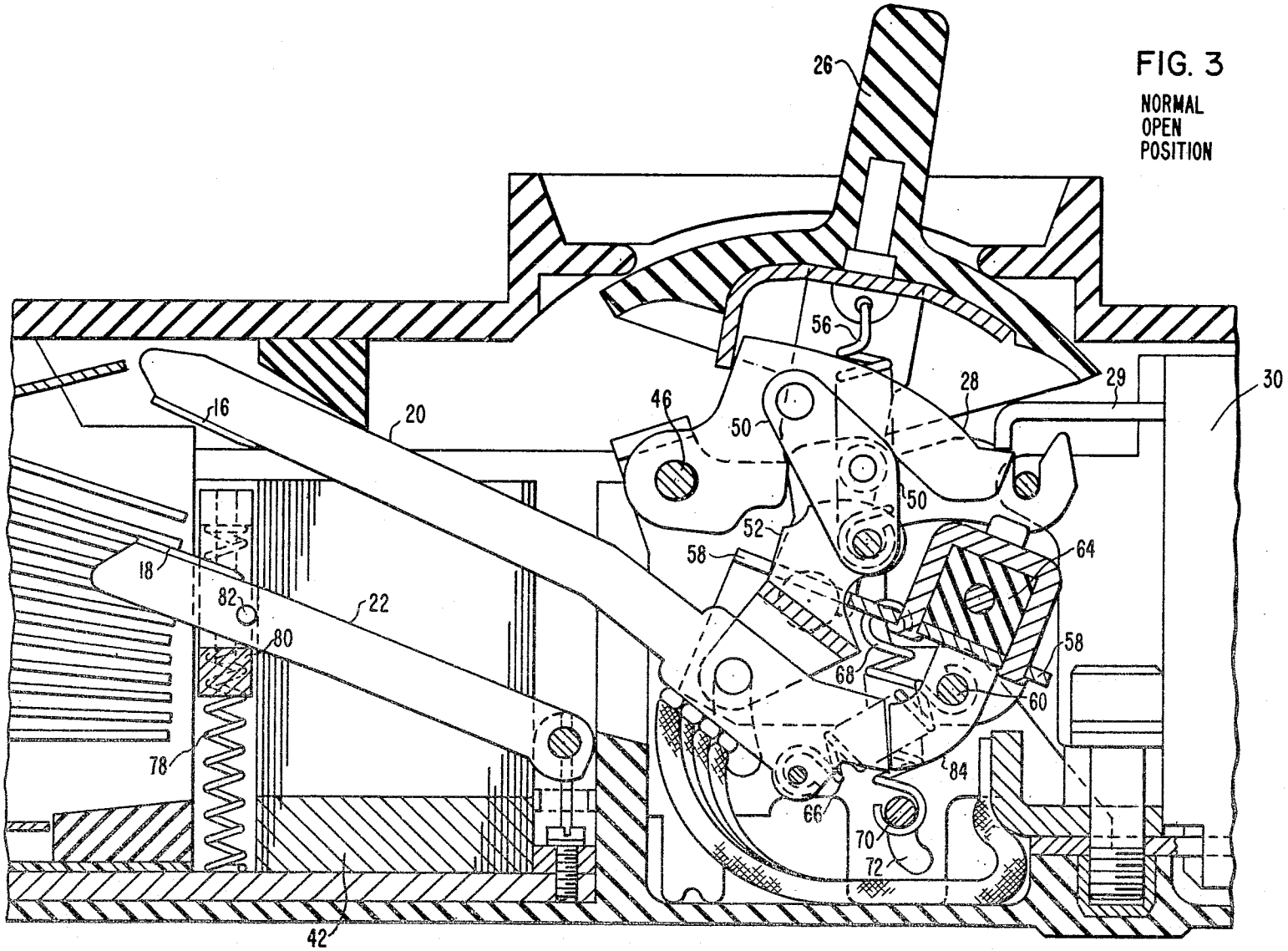
FIG. 3 is a view similar to FIG. 2, with the contacts and operating mechanism shown in the normal open position.

When the circuit breaker is operated to the normal open position by manual operation of the handle 26, the mechanism assumes the position shown in FIG. 3. As can be seen, the upper and lower toggle links 50 and 52 have collapsed, allowing the carriage 58 to rotate in a clockwise direction about the carriage pivot pin 60. The upper contact arm 20 has also pivoted as a unit with the carriage 58 to separate the contacts 16 and 18. The light extension springs 66 operate upon the upper contact arm 20, drawing it up against a pickup block 84 attached to the carriage 58. Force from the heavy spring 68 is no longer acting upon the contact arm 20, since the latch pin 70 (through which the force of the spring 68 acts when the circuit breaker is in the closed position) is constrained by the upper end of the slot 72 and is no longer in contact with the contact arm 20. The lower contact arm 22 has risen slightly from its closed position shown in FIG. 2 to the position shown in FIGS. 3 under the action of the compression spring 78. The upper limit of travel of the lower contact arm 22 is determined by the action of the limit pin 82 against the side of the slot motor 42.

Figure 4:
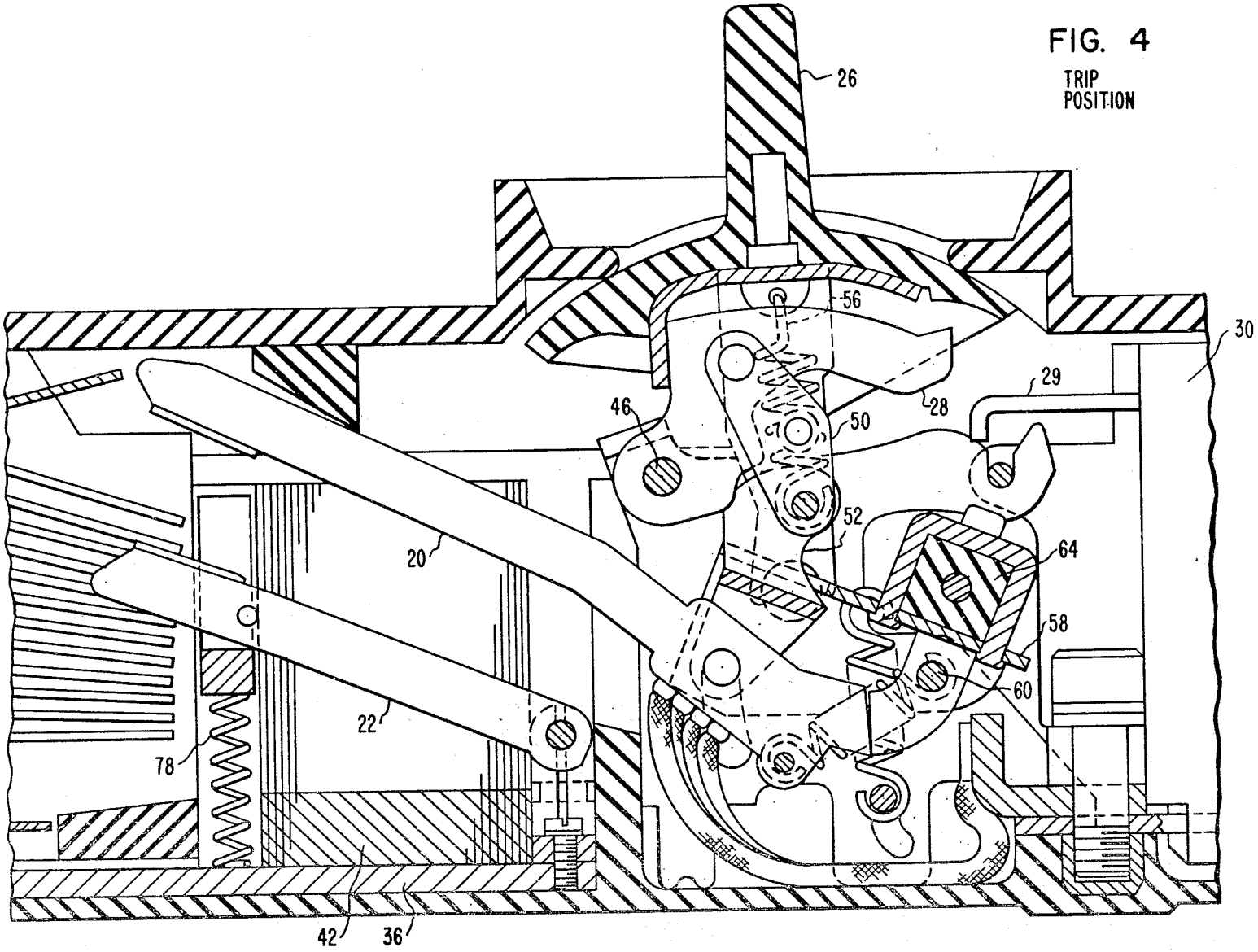
FIG. 4 is a view similar to FIGS. 2 and 3, with the contacts and mechanism shown in the tripped position.

Under low to moderate overload conditions, the trip device 30 will actuate to move the member 29 and release the trip latch 28. The circuit breaker will then move from the position of FIG. 2 to assume the position shown in FIG. 4. The trip latch 28 rotates in a counterclockwise direction but the latch pivot 46 under the influence of the extension operating spring 56. This causes the toggle linkage composed of links 50 and 52 to collapse, allowing the carriage 58 to rotate in a clockwise direction about the carriage pivot pin 60. The handle 26 is moved to the center trip position as shown in FIG. 4, and the cross arm 64 rotates with the carriage 58 to open the other poles of the circuit breaker. All other members of the circuit breaker assume the same positions as in the normal open position shown in FIG. 3.

Severe overload currents flowing through the circuit breaker 10 when in the closed position shown in FIG. 2 generate high electrodynamic forces upon the contact arms 20 and 22 tending to separate the contacts 16 and 18 and pivot the arms 20 and 22 in opposite directions. An additional separation force is provided by the current flow through the conductor 36 and arm 22 which induces magnetic flux in the slot motor 42 to pull the arm 22 toward the bottom of the slot. Since the trip latch 28 and toggle linkage 50, 52 are not immediately affected, they and the carriage 58 remain in the position shown in FIG. 2. Thus, the electrodynamic force upon the upper contact arm 20 causes it to rotate about the contact arm pivot pin 48. In the initial stages of this rotation, the reaction surface 74 bears upon the latch pin 70, causing the pin 70 to move downard in the guide slot 72. At first, the pin 70 moves downward in the guide slot 72 against the action of the spring 68. The force of the spring 68 therefore increases proportionately with the displacement of the contact arm 20, resisting the electrodynamic force caused by overload current and tending to oppose the current limiting action. However, the guide slot 72 is shaped to push the latch pin 70 away from the contact arm 20, and about halfway through the travel of the contact arm (before the spring 68 has appreciably extended), the reaction surface 74 disengages from the latch pin 70, allowing the released force of the spring 68 to pull the latch pin 70 to the top of the guide slot 72. The point at which disengagement occurs between the contact arm 20 and latch pin 70 can, of course, be regulated by proper design of the guide slot 72.

Figure 5:
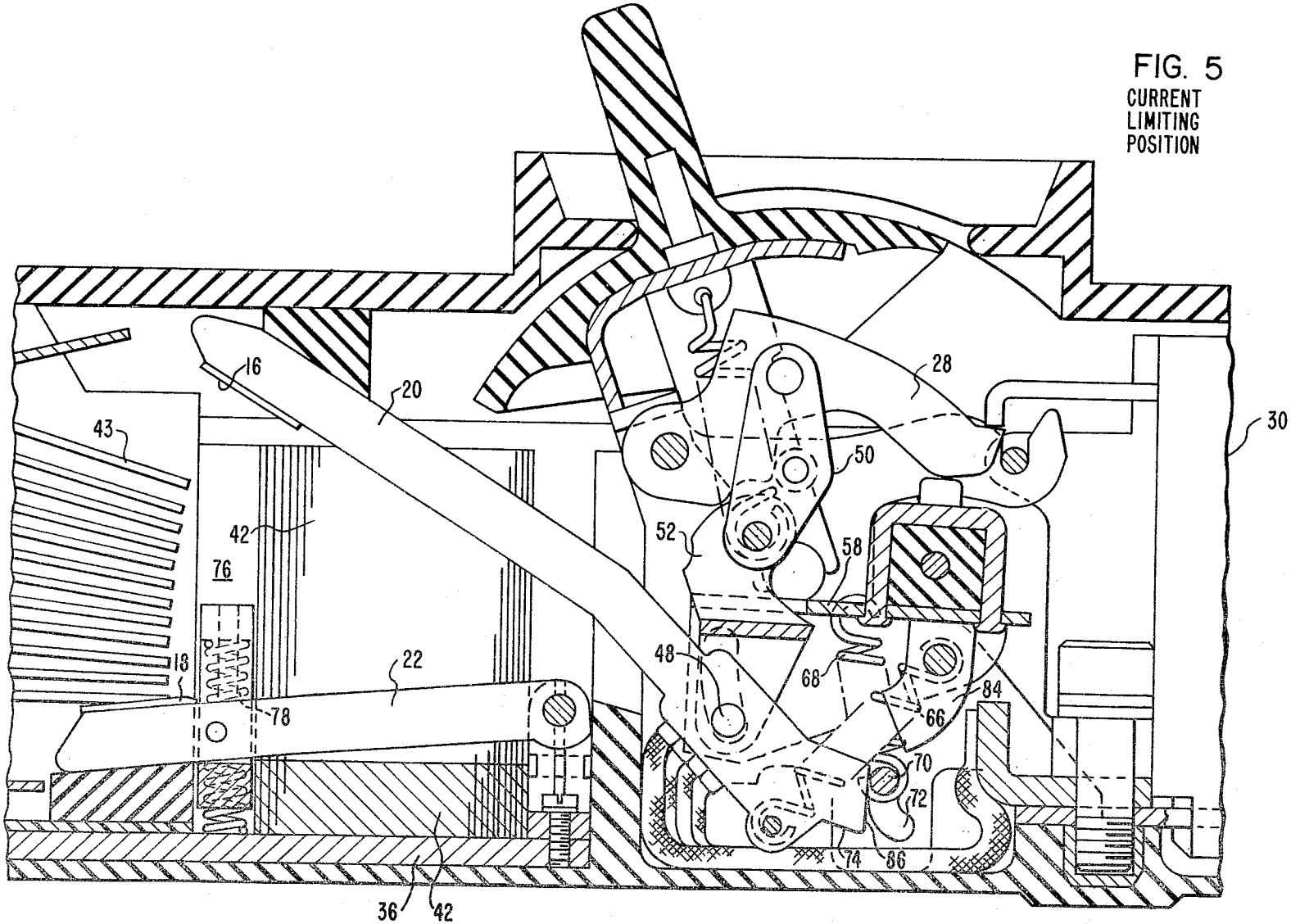
FIG. 5 is a view similar to FIGS. 2 through 4, with the contacts and mechanism shown in a current limiting position.

As can be seen in FIG. 5, when the latch pin 70 is at its upper extremity in the slot 72, it bears against a latch surface 86 of the contact arm 20. Thus, even though the light extension spring 66 is applying force tending to rotate the contact arm 20 in a counterclockwise direction and return the arm 20 to a closed circuit position, this tendency is prevented by the latching action of the latch pin 70.

As the arms 20 and 22 move to the current limiting position of FIG. 5, an arc is drawn between contacts 16 and 18. Although this arc is forced against the plates 43 and is fairly rapidly extinguished thereon, the current flow until arc extinction is sufficient to activate the trip device 30 to release the trip latch 28. This action allows the carriage 58 to rotate in a clockwise direction and the latching surface 86 to ride upward along the latch pin 70 until it is released therefrom. When the carriage 58 has rotated a degree sufficient to release the surface 86 from the latch pin 70, the light extension spring 66 pivots the contact arm 20 in a counterclockwise direction until the surface 86 contacts the pickup block 84. At this time, the circuit interrupter assumes the position shown in FIG. 3.

It can be seen that the amount of contact closing force present during normal closed circuit conditions can be determined by proper selection of the characteristics of the spring 68. This force can then be released from the contact arm at any desired point in the current limiting pivoting action of the contact arm 20 by proper selection of the position and shape of the guide slot 72. By providing for early release of the contact arm 20, the force resisting acceleration of the arm 20 can be minimized since the spring 68 will not have stretched to produce a higher spring force. This not only increases the current limiting effect of the circuit breaker but reduces mechanical stress on the contact arm during the current limiting process. Since a strong spring is used which is not required to be stretched a great deal, the stress upon the spring is also minimized, increasing the reliability and useful life of the spring. Furthermore, since a common spring is used for providing contact closing force during closed circuit conditions and for providing latching force during current limiting operations, the complexity of the operating mechanism is reduced. It can be seen therefore that the present invention provides a current limiting circuit interrupter having an improved latch release mechanism, resulting in increased performance and lower costs.

I claim:

1. A current limiting circuit interrupter, comprising:

separable contacts;

a mechanism frame;

contact support means supporting one of said contacts and pivotally attached to said frame, said contact support means comprising a reaction surface and a latching surface;

conductor means connected to said contacts for connecting said contacts in series circuit relation with an electrical circuit being protected, said conductor means arranged to generate magnetic flux to apply electrodynamic force to said contact support means in a direction tending to separate said contacts when electrical current flows through said conductor means;

a member movably attached to said frame and movable between first and second positions; and an operating spring connected to said movable member and urging said movable member against said reaction surface of said contact support means to provide contact closing force thereto when said movable member is in said first position, said operating spring urging said movable member against said latching surface of said contact support means to apply latching force thereto for maintaining said contacts in an open position when said movable member is in said second position;

a severe overcurrent condition through said conductor means generating sufficient electrodynamic force to move said contact support means to separate said contacts and displace said movable member from the first to the second position.

2. A current limiting circuit interrupter as recited in claim 1 wherein said movable member comprises a longitudinal member having its major axis generally parallel to the pivoting axis of said contact support means.

3. A current limiting circuit interrupter as recited in claim 2 wherein said frame comprises a plurality of slots and said longitudinal member is positioned in said slots.

4. A current limiting circuit interrupter as recited in claim 1 wherein said contact support means comprises a carriage pivotally attached to said frame and operable between open and closed positions and a contact arm pivotally attached to said carriage, said contact arm including said reaction and latching surfaces.

5. A current limiting circuit interrupter as recited in claim 4 wherein said spring is connected between said movable member and said carriage.

6. A current limiting circuit interrupter as recited in claim 5 wherein said frame comprises means limiting the travel of said carriage.

7. A current limiting circuit interrupter as recited in claim 6 wherein said carriage limiting means comprises a pair of slots and said contact arm is pivoted about a pin extending through said carriage and into said slots.

8. A current limiting circuit interrupter as recited in claim 5 comprising a return spring connected between said frame and said contact arm.

9. A current limiting circuit interrupter as recited in claim 8 wherein said operating spring and said return spring both provide contact closing force when said contacts are in the closed position.

10. A current limiting circuit interrupter as recited in claim 9 wherein said operating spring provides the majority of contact closing force.

11. A current limiting circuit interrupter as recited in claim 8 comprising a latch mechanism connected to said frame and said contact support means, and trip means for cooperating with said latch mechanism and for responding to current through said contacts such that overcurrent conditions through said contacts cause said trip means to release said latch mechanism and pivot said contact support means to separate said contacts.

12. A current limiting circuit interrupter as recited in claim 11 wherein said carriage, said contact arm, and said movable member are so located in relation to each other that rotation of said carriage to the open position when said movable member is in said second position is operable to move said latching surface out of contact with said movable member and allow said return springs to pivot said contact arm, rotation of said carriage to the closed position then being operable to bring said reaction surface into contact with said movable member and move said movable member into said first position.

13. A current limiting circuit interrupter as recited in claim 5 comprising a pair of slots in said frame limiting the travel of said movable member.

14. A current limiting circuit interrupter as recited in claim 13 wherein said slots are shaped to position said movable member at a distance from the pivot axis of said contact arm in direct relation to the stress of said operating spring.

* * * * *